US012421837B2

(12) United States Patent
Tasoujian et al.

(10) Patent No.: US 12,421,837 B2
(45) Date of Patent: Sep. 23, 2025

(54) REAL-TIME AUTOMATED GEOSTEERING INTERPRETATION USING ADAPTIVE COMBINED HEATMAPS

(71) Applicant: Halliburton Energy Services, Inc., Houston, TX (US)

(72) Inventors: Shahin Tasoujian, Houston, TX (US); Siyang Song, Houston, TX (US); Eirik Hansen, Stavanger (NO); Robert P. Darbe, Houston, TX (US); Vytautas Usaitis, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 414 days.

(21) Appl. No.: 17/852,646

(22) Filed: Jun. 29, 2022

(65) Prior Publication Data

US 2024/0003240 A1 Jan. 4, 2024

(51) Int. Cl.
*E21B 44/02* (2006.01)
*E21B 7/04* (2006.01)
(Continued)

(52) U.S. Cl.
CPC ..... *E21B 44/02* (2013.01); *E21B 41/00* (2013.01); *E21B 47/04* (2013.01); *E21B 7/04* (2013.01); *E21B 44/00* (2013.01)

(58) Field of Classification Search
CPC ..... E21B 44/02; E21B 41/00; E21B 47/04; E21B 7/04; E21B 44/00
See application file for complete search history.

(56) References Cited

U.S. PATENT DOCUMENTS 10,167,713 B2 1/2019 Ma et al.
11,396,801 B2 * 7/2022 Ba ..... E21B 47/024
(Continued)

FOREIGN PATENT DOCUMENTS

WO 2020028305 A1 2/2020
WO WO-2022072924 A1 * 4/2022 ..... G08B 21/187

OTHER PUBLICATIONS

Gee, et al.; "Improving Wellbore Placement Accuracy Using Stratigraphic Misfit Heatmaps"; SPE/AAPG/SEG Asia Pacific Unconventional Resources Technology Conference; URTEC-198221-MS; Nov. 18-19, 2019; 9 pgs.

*Primary Examiner* — Robert E Fennema
*Assistant Examiner* — Yvonne Trang Follansbee
(74) *Attorney, Agent, or Firm* — Benjamin Ford; Parker Justiss, P.C.

(57) ABSTRACT

An intuitive automated geosteering interpretation method and system that creates a geological model of a subterranean formation using an adaptive combined heatmap is provided. The adaptive combined heatmap is generated from individual heatmaps that each correspond to a specific type of drilling data (e.g. sensor readings) and then combined with adaptive weightings. An example of an automated method of drilling a target well using a well plan, includes: (1) generating at least two individual heatmaps for a subterranean formation using target well drilling data from a target well and offset well data from at least one offset well, wherein each of the individual heatmaps correspond to a specific type of drilling data, (2) generating an adaptive combined heatmap from the individual heatmaps, (3) determining a path of the target well in the subterranean formation based on the adaptive combined heatmap, and (4) updating the well plan according to the path.

18 Claims, 10 Drawing Sheets

(51) Int. Cl.

| | |
|---|---|
| ***E21B 41/00*** | (2006.01) |
| ***E21B 44/00*** | (2006.01) |
| ***E21B 47/04*** | (2012.01) |

(56) References Cited

U.S. PATENT DOCUMENTS

| | | | | |
|---|---|---|---|---|
| 2003/0046005 | A1* | 3/2003 | Haarstad | E21B 47/022 702/9 |
| 2015/0315897 | A1 | 11/2015 | Samuel et al. | |
| 2020/0300064 | A1* | 9/2020 | Gee | E21B 43/305 |
| 2020/0340350 | A1 | 10/2020 | Denisenko et al. | |
| 2021/0079778 | A1 | 3/2021 | Ba et al. | |
| 2021/0222523 | A1 | 7/2021 | Sun et al. | |
| 2022/0018242 | A1 | 1/2022 | Marsala et al. | |
| 2022/0170359 | A1* | 6/2022 | Boualleg | G06N 20/20 |

* cited by examiner

800

REAL-TIME AUTOMATED GEOSTEERING INTERPRETATION USING ADAPTIVE COMBINED HEATMAPS

TECHNICAL FIELD

This disclosure relates to drilling boreholes in subterranean formations and, more specifically, to automated interpretation of borehole data to use for drilling the boreholes.

BACKGROUND

In a geosteering operation of a target well, geologists or directional drillers use the logging-while-drilling (LWD) logs, such as the gamma-ray, resistivity, density, porosity logs, etc., and directional drilling data to interpret the target subterranean formation and estimate the borehole position or relative location of the target well in the various layers of the subterranean formation. The LWD logs of the target well are usually compared and correlated with logs of an offset well to interpret the position of the target well and construct a geological model that can be used for drilling. Typically, geologists manually interpret the formation data and correlate the LWD logs of a target well to the available logs of one more offset wells. From the manual interpretation, steering decisions for the target well can be made based on the understanding of the formation.

SUMMARY

In one aspect, the disclosure provides an automated method of drilling a target well according to a well plan. In one example the automated method includes: (1) generating at least two individual heatmaps for a subterranean formation using target well drilling data from a target well and offset well data from at least one offset well, wherein each of the individual heatmaps correspond to a specific type of drilling data, (2) generating an adaptive combined heatmap from the individual heatmaps, (3) determining a path of the target well in the subterranean formation based on the adaptive combined heatmap, and (4) updating the well plan according to the path.

In yet another aspect, the disclosure provides an automated directional drilling system, comprising one or more processors to perform operations. In one example, the operations include: (1) generating at least two individual heatmaps for a subterranean formation using target well drilling data from a target well and offset well data from at least one offset well, wherein each of the individual heatmaps correspond to a specific type of drilling data, (2) generating an adaptive combined heatmap from the individual heatmaps, wherein the individual heatmaps are adaptively weighted for measured depths of the target well, and (3) steering a drill bit in the subterranean formation based on the adaptive combined heatmap.

In still another aspect, the disclosure provides a computer program product including a non-transitory computer readable medium having a series of operating instructions that direct a processor when initiated thereby to automatically interpret geological data of a subterranean formation and a position of a target well in the subterranean formation in real-time by performing operations. In one example the operations include: (1) generating at least two individual heatmaps for a subterranean formation using target well drilling data from a target well and offset well data from at least one offset well, wherein each of the individual heatmaps correspond to a specific type of drilling data, (2) adaptively weighting the individual heatmaps for measured depths of the target well, (3) generating an adaptive combined heatmap from the adaptively weighted individual heatmaps, and (4) determining a path of the target well in the subterranean formation using the adaptive combined heatmap, wherein the path is a low cumulative misfit path on the adaptive combined heatmap.

BRIEF DESCRIPTION

Reference is now made to the following descriptions taken in conjunction with the accompanying drawings, in which.

Figure 9:
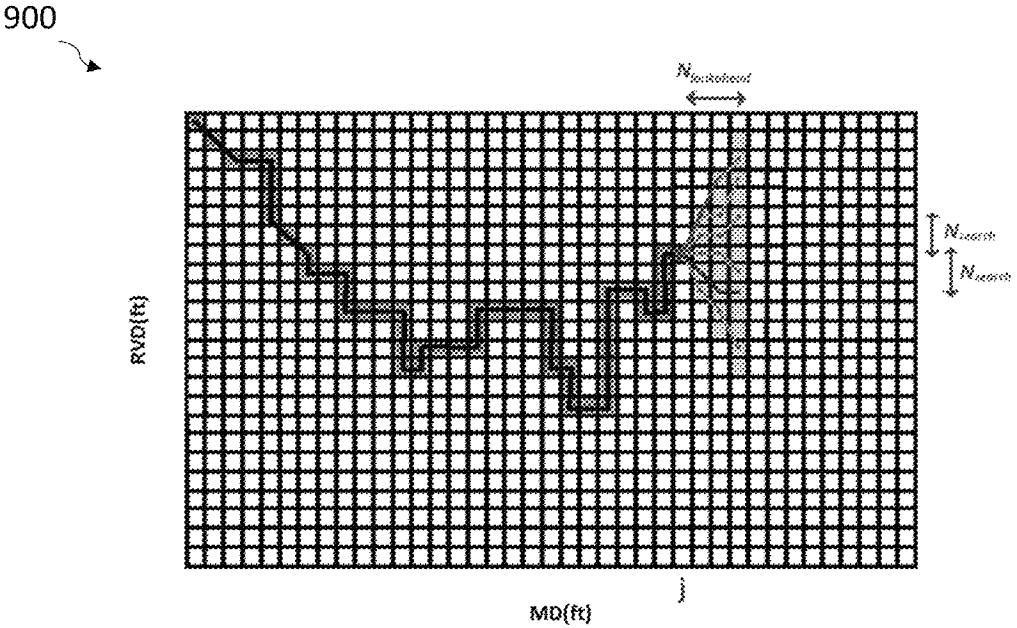
Figure 10:
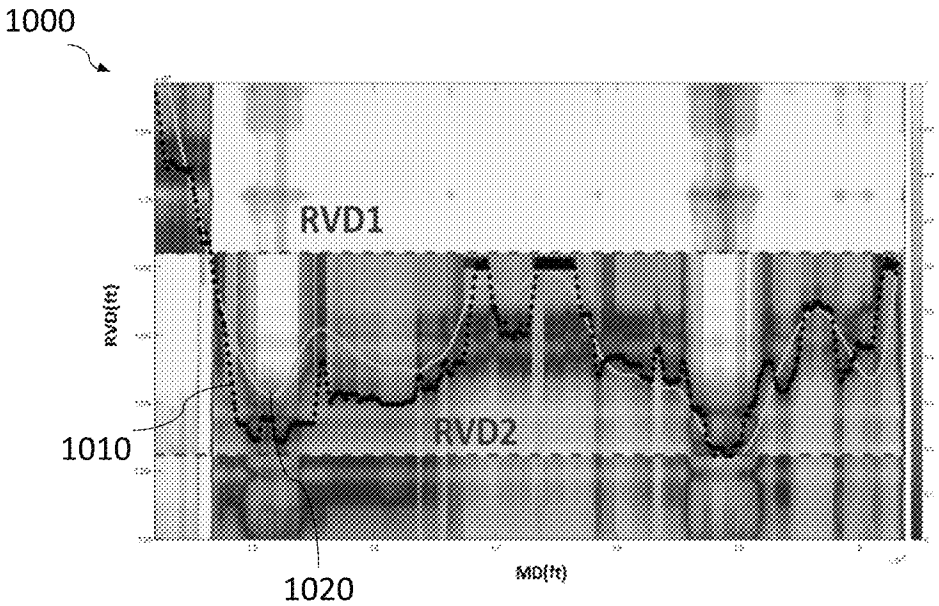

FIG. 9 illustrates a heatmap matrix and an example of a process of determining a path for a target well according to the principles of the disclosure; and FIG. 10 illustrates an example of an adaptive combined heatmap 1000 that includes a human interpretation of a drilling geosteering job and an automated interpretation of the drilling geosteering job determined according to the principles of the disclosure.

DETAILED DESCRIPTION

Manual correlating and interpreting the LWD logs of a target well and offset well can result in errors and inaccuracies. The manual operation is also subjective wherein the geological interpretations highly depend on human factors, such as the experience of the geologist or driller. Accordingly, an improved process for creating a geological model that can be used for geosteering a target well would be beneficial in the industry.

The disclosure provides an intuitive automated geosteering interpretation method and system that creates a geological model of a subterranean formation using an adaptive combined heatmap method. The adaptive combined heatmap is generated from individual heatmaps that each correspond to a specific type of drilling data (e.g. sensor readings) and then combined with adaptive weightings. From the geological model, a path for a target well can be determined and used for geosteering, including automated geosteering.

Compared with the current technology, the disclosed method and system provide an intuitive solution that interprets the borehole location or position of a target well in a subterranean formation and constructs more accurate geological models using target well drilling data and offset well data from at least one offset well. The target well drilling data includes data from one or more of the LWD logs, measure-while-drilling (MWD) logs, or directional drilling data from the target well. The target well drilling data can be obtained in real-time while drilling. The geological models can be modified in real-time while drilling and used to direct drilling of the target well, which can improve the placement of the target well in a target zone for optimum well placement and hence increase the production and decrease drilling time and costs. The improved geological model can be provided to a driller for manual geosteering and can also be used for automated geosteering. For manned geosteering operations, the disclosed system and method can help human operators monitor the target well drilling data and provide guidance for steering decisions. For automated geosteering, the disclosed system and method can reduce the workload of geologists and improve the quality of the interpretations by suggesting faster and more accurate decisions and interpretations. The automated implementation can reduce the workload of a human operator and the chance of missing a control point. Therefore, the disclosed solution can reduce the operational cost and risk of geosteering operations.

An example of an automated geosteering method according to the disclosure can include multiple steps. The first step is constructing individual heatmaps using target well drilling data and offset well data. The target well drilling data and the offset well data can be processed to remove noise or other anomalies before being used for constructing the individual heatmaps. Each of the individual heatmaps will correspond to a single type of drilling data. For example, a gamma-ray heatmap, a resistivity heatmap, a density heatmap, etc. Second, an adaptive combined heatmap will be constructed using a varying adaptive law, or adaptive weighting criteria. Next, an online interpretation procedure for target wellbore localization or finding target borehole position in the geology is initiated using an optimization-based pathfinder on the final adaptive combined heatmap. A pathfinder algorithm can be used that is simply looking for a low cumulative misfit path on the adaptive combined heatmap which represents the most probable borehole location/position of the target well in the geology relative to stratigraphic layers.

Figure 1:
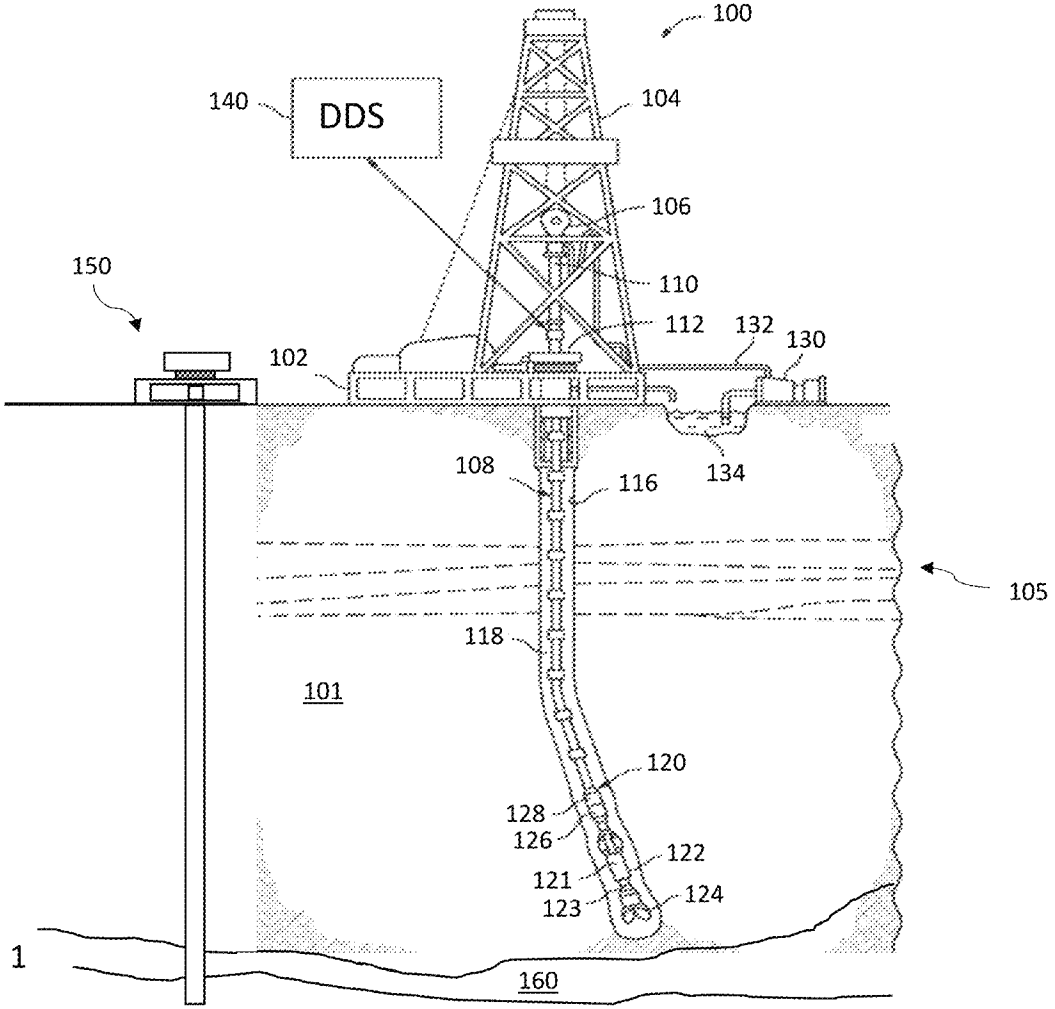
FIG. 1 illustrates a system diagram of an example of a well system having an offset well and a target well that is drilled according to the principles of the disclosure.

Turning now to the figures, FIG. 1 illustrates an example of a well system 100 that is used to direct a drill bit to drill a wellbore (i.e., a target well) within a subterranean formation according to the principles of the disclosure. The system 100 is directed to drilling a wellbore on land for retrieving hydrocarbons, such as oil and gas, but the disclosed processes and systems can also be used to retrieve hydrocarbons from subsea locations. The disclosed processes and systems can also be used with other subterranean drilling applications including: geothermal wellbores, water wells, boreholes for mineral extraction, such as salts or brines, for placement of communications or power cables underground, or for placement of residential gas piping. Data from one or more offset well may be used by the well system 100 for drilling the target well. In FIG. 1, a single offset well, offset well 150, is shown as an example.

The well system 100 includes a drilling platform 102 that supports a derrick 104 having a traveling block 106 for raising and lowering a drill string 108. A kelly 110 supports the drill string 108 as the drill string 108 is lowered through a rotary table 112. A top drive (not illustrated) can be used to rotate the drill string 108.

The well system 100 also includes a BHA 120 disposed in a directional borehole 116 that extends into subterranean formation 101. The BHA 120 is a directional drilling BHA, which can include a mud motor a rotary steerable system or another type of direction drilling technology, and a drill bit 124 that is positioned at the downhole end of the BHA 120. Mud motor 121 is used with well system 100 as an example. The drill bit 124 may be driven by the mud motor 121 and/or rotation of the drill string 108 from the surface. As the drill bit 114 rotates, the drill bit 114 creates the borehole 116 that passes through various formation layers denoted by element number 105. A pump 130 circulates drilling fluid through a feed pipe 132 and downhole through the interior of drill string 108, through orifices in drill bit 124, back to the surface via annulus 118 around drill string 108, and into a retention pit 134. The drilling fluid transports cuttings from the borehole 116 into the pit 134 and aids in maintaining the integrity of the borehole 116.

The BHA 120 includes tools that collect target well drilling data including survey trajectory data, formation properties and various other drilling conditions as the drill bit 114 extends the borehole 116 into the subterranean formation 101 to target zone 160. The tools can include one or more LWD or MWD tools 126 that collect measurements while drilling. The LWD/MWD tool 126 may include devices for measuring lithographic information such as formation resistivity and gamma ray intensity, devices for measuring the inclination and azimuth of the BHA 120, pressure sensors for measuring drilling fluid pressure, temperature sensors for measuring borehole temperature, etc.

The BHA 120 may also include a telemetry module 128. The telemetry module 128 receives measurements provided by various downhole sensors, e.g., sensors of the LWD/MWD tool 126, and transmits the measurements to a direction drilling system (DDS) 140. Similarly, data provided by the DDS 140 is received by the telemetry module 128 and transmitted to the BHA 120 and its tools, e.g., the LWD/MWD tool 126 and the mud motor 121. In some examples, mud pulse telemetry, wired drill pipe, acoustic telemetry, or other telemetry technologies known in the art may be used to provide communication between the DDS 140 and the telemetry module 128.

The mud motor 121 includes a housing 122 disposed about a steerable shaft 123. In this example, the steerable shaft 123 transfers rotation through the mud motor 121. A deflection or cam assembly surrounding the shaft 123 is rotatable within the housing 122 (which can be a rotation resistant housing) to orient the deflection or cam assembly such that the shaft 123 can be positioned in the borehole causing a change in trajectory. The mud motor 121 may include or be coupled to directional sensors (e.g., a magnetometer, gyroscope, accelerometer, etc.) for determination of its state, e.g., azimuth and inclination with respect to a reference direction and reference depth.

The mud motor 121 is configured to change the direction of the BHA 120 and/or the drill bit 124, based on control inputs, e.g., steering commands, from the DDS 140. The DDS 140 provides the steering commands based on a well plan for drilling the target well. The DDS 140 can update the well plan based on an adaptive combined heatmap and an observable path through the adaptive combined heatmap. The adaptive combined heatmap is generated from multiple individual heatmaps based on the target well drilling data and offset well data from offset well 150. The well plan can be updated in real-time as the target well is being drilled. The DDS 140 can be, for example, DDS 200 of FIG. 2. It is understood that the placement of the DDS 140 is not limited to at or near the surface and may be located down, e.g., within the BHA 120 near the mud motor 121.

Figure 2:
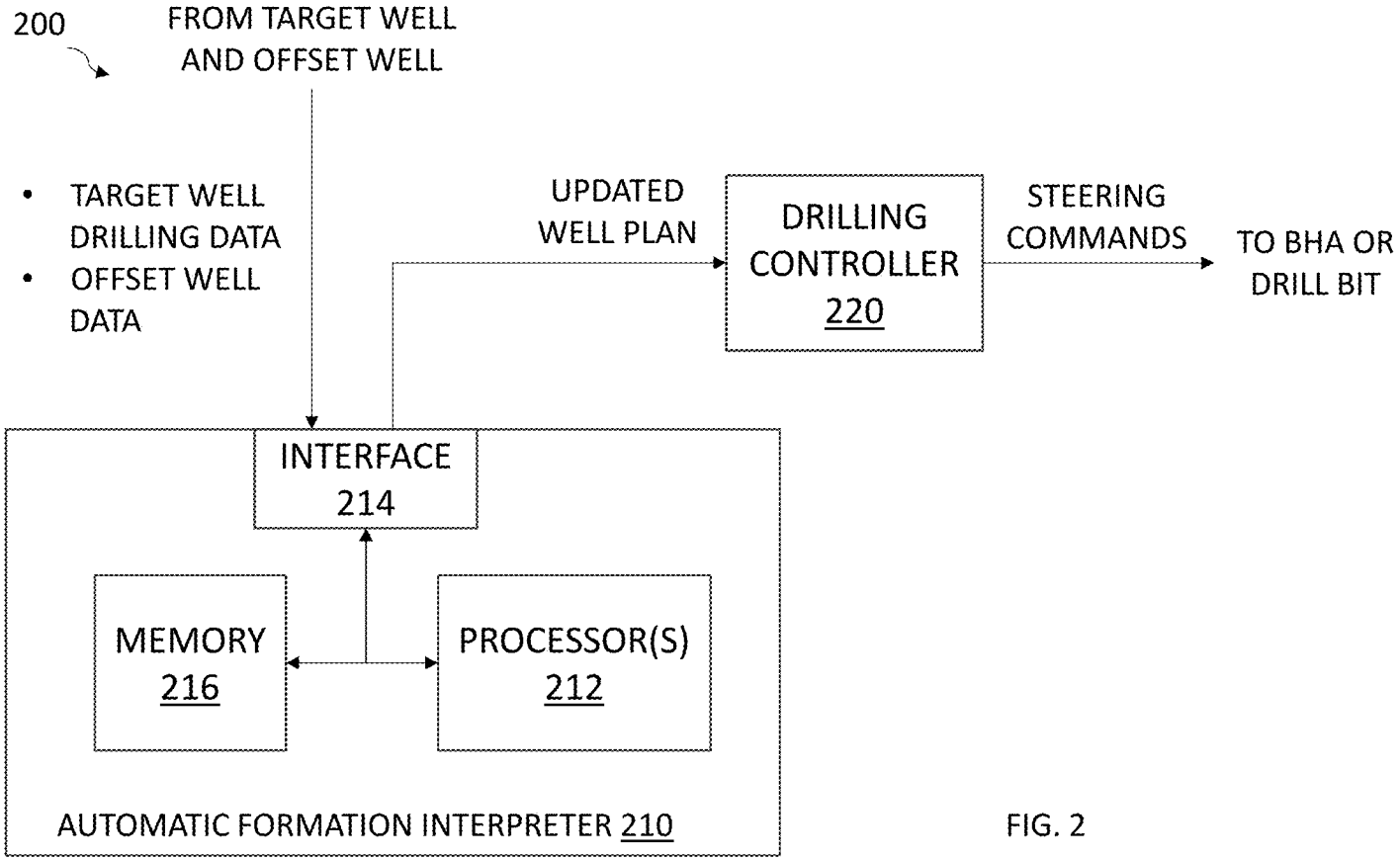
FIG. 2 illustrates a block diagram of an example of a directional drilling system (DDS) constructed according to the principles of the disclosure.

FIG. 2 illustrates a block diagram of an example of a DDS 200, such as DDS 140 in FIG. 1, which is constructed according to the principles of the disclosure. The DDS 200 directs the steering of a drill bit, such as drill bit 124, according to a well plan. The DDS 200 includes an automatic formation interpreter (AFI) 210 and a drilling controller 220. One skilled in the art will understood that although not shown, the DDS 200 may include other components of a directional drilling system.

The AFI 210 is configured to automatically review and interpret target well drilling data and offset well data and automatically determine a path for a target well in a subterranean formation using the interpretation. Based on the determined path, the AFI 210 can then update a geological mode and a well plan that can be used for directional drilling. The AFI 210 includes one or more processors, represented by processor 212, an interface 214, and a memory 216 that are communicatively connected to one another using conventional means.

The processor 212 is configured to automatically determine a path of a target well in a subterranean formation using at least one adaptive combined heatmap generated from multiple individual heatmaps. The updated well plan can be provided to the drilling controller 220 for making steering decisions. The processor 212 can operate according to an algorithm corresponding to at least some of the steps of the method 300 in FIG. 3. The algorithm can be represented as a series of operating instructions stored on the memory 216.

The processor 212 may be any data processing unit, such as a central processing unit, a graphics processing unit, and/or a hardware accelerator. It is understood that the number of processors and the configuration that can be used for the AFI 210 is not limited as illustrated. For example, multiple processors can be used for the AFI 210.

The interface 214 receives and transmits data of the AFI 210. The interface 214 receives target well drilling data and offset well data. The target well drilling data can be received in real-time during drilling of the target well. For example, the target well drilling data can be real-time sensor measurements from various downhole sensors, e.g., sensors of a MWD or LWD tool and/or directional sensors. The sensors can include, for example, at least one of gamma-ray sensors, resistivity sensors, density sensors, porosity sensors, drilling dynamic sensors, acoustic sensors, or nuclear magnetic resonance sensors. A combination of the different type of sensors can also be used. The offset well data can be historical data from a database or other data storage device. The offset well data may be stored on the memory 216. The interface 214 forwards the received data to the processor 212 and transmits an output of the AFI 210. As illustrated in FIG. 2, the output can be an updated well plan. The updated well plan can be based on a modified geological model according to an adaptive combined heat map generated by the AFI 210. The interface 214 transmits the updated well plan to drilling controller 220. The interface 214 may be implemented using conventional circuitry and/or logic.

Figure 3:
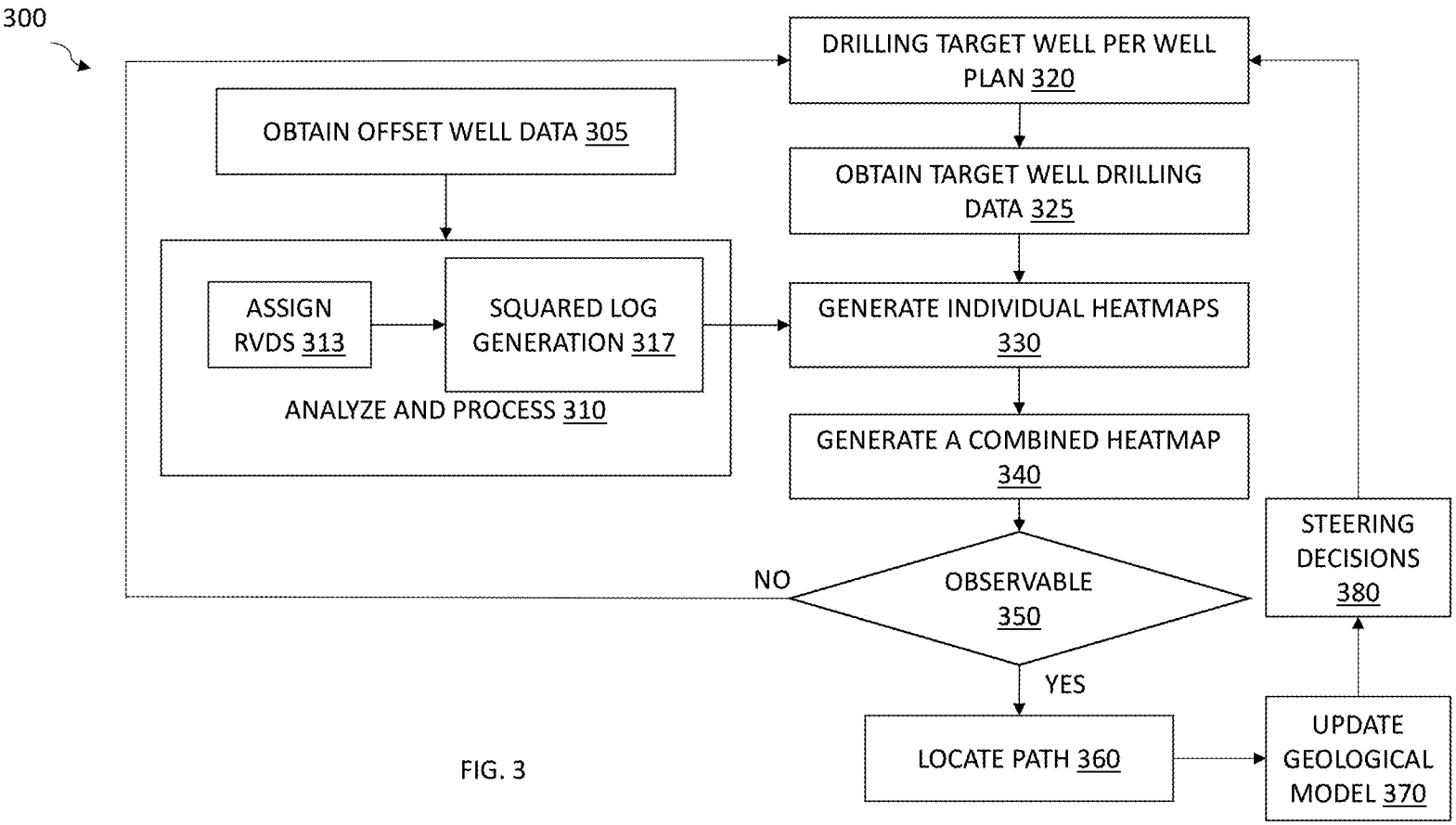
FIG. 3 illustrates a flow diagram of an example method for automated directional drilling according to the principles of the current disclosure.

The memory 216 can be a non-transitory memory that stores data, e.g., real-time sensor measurements and historical data, which is needed in performing the disclosed methodology, e.g., method 300 of FIG. 3. The memory 216 also store a series of instructions that when executed, causes the processor 212 to perform the disclosed methodology. The memory 216 may be a conventional memory device such as flash memory, ROM, PROM, EPROM, EEPROM, DRAM, SRAM and etc.

FIG. 3 illustrates a flow diagram of an example of a method 300 of drilling a target well carried out according to the principles of the disclosure. Method 300 includes using an adaptive combined heat map generated from target well drilling data and offset well data. A path for the target well can be determined from the adaptive combined heat map and used to update a well plan for directing the drilling. At least some of the steps of method 300 can be performed by an AFI, such as AFI 210. Method 300 starts in step 305 with obtaining offset well data.

The offset well data is obtained from at least one offset well. Offset wells are preferably chosen in the same vicinity of the target well and/or selected due to having similar formation characteristics. Offset well 150 of FIG. 1 provides an example offset well. The offset well data can be stored in and retrieved from a database that is either proximate or remote from the target well. The offset well data can be stored in, for example, a memory of a DDS, such as in memory 216 of AFI 210. When multiple offset wells are used, the data can be combined for each specific type of drilling data and used as a single representation of the offset wells. Interpolation and kriging can be used to combine the offset well data from different offset wells.

The offset well data can be from data logs corresponding to sensor measurements collected while drilling the offset well. The sensor measurements may include but are not limited to gamma-ray, resistivity, density, porosity, drilling dynamics, etc., and may be used. The offset well data can be stored as raw data that needs to be analyzed and processed (e.g., preprocessed) before being used in method 300 to interpret the target well drilling data.

Figure 4:
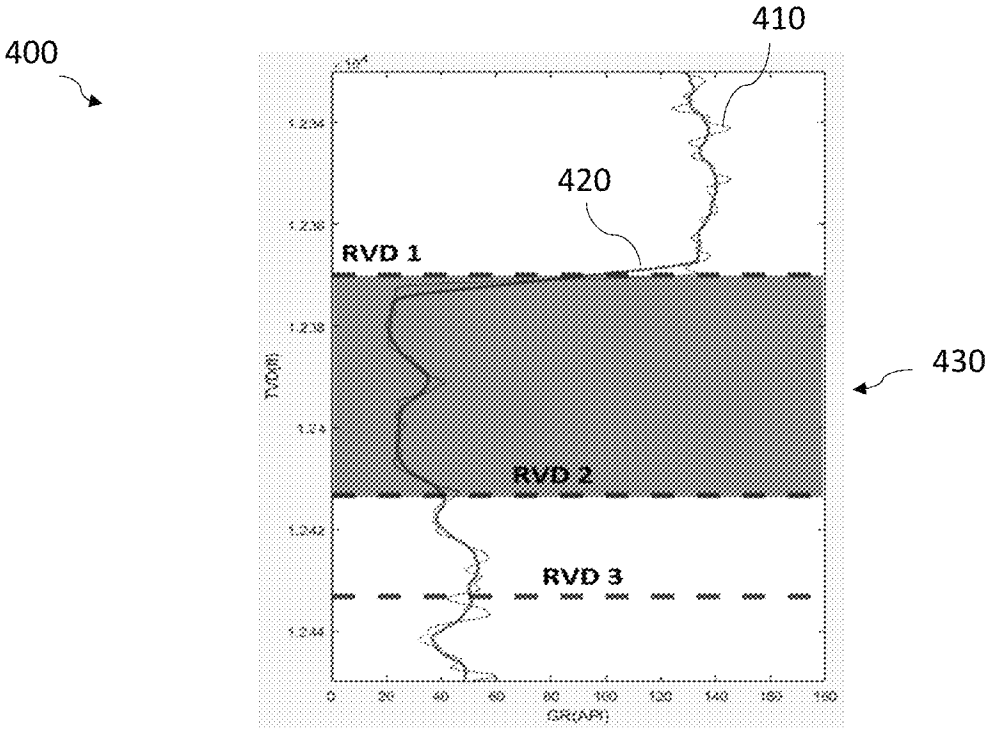
FIG. 4 illustrates a diagram of an example of offset well data that has been analyzed to identify geological characteristics and mark the geological characteristics with reference vertical depths (RVDs)

In step 310, the offset well data is analyzed and processed. Steps 313 and 317 provide examples of analyzing and processing, respectively. Additional or different analysis and processing can be performed on the offset well data. By analyzing offset well data, geological characteristics of the subterranean formation are detected. The geological characteristics include, for example, events, patterns (e.g. sweet zone, petrophysical changes, etc.), features of interest, or formation layer changes (bed boundaries) that are detected. In step 313, a Reference Vertical Depth (RVD) is assigned for the True Vertical Depth (TVD) of selected geological characteristics from the offset well data. The patterns to assign RVDs may include, but are not limited to, an abrupt change in an offset well log reading. For example, an abrupt change in gamma-ray data can indicate penetration of a formation boundary and a separation between density and porosity data may indicate the presence of hydrocarbons. FIG. 4 illustrates a diagram 400 as an example of offset well data that is from a gamma-ray log, in which three features or events are selected as references and RVDs are assigned to each. Raw gamma-ray data 410 and processed gamma-ray data 420 are illustrated. In FIG. 4 the x axis is gamma ray readings in American Petroleum Institute (API) units and the y axis is TVD. RVD1 is chosen because of a sharp change in the gamma-ray reading (that may indicate a change of formation layer/bed boundary crossing), and RVD 2 and RVD 3 may be selected by the geologist using other logs such as resistivity, density, porosity, etc. Moreover, the shaded zone 430 on the diagram 400 between RVD 1 and RVD 2 is selected to indicate a target zone (zone of interest), such as target zone 160 in FIG. 1. The multiple features/events/markers can be selected, such as by a geologist, before drilling of the target well begins and a different RVD can be assigned for each of the selected markers. The selected RVDs from offset well logs will appear flat in a final interpretation heat map, which is in an RVD-measured depth (MD) domain. The corresponding layer/feature/event, however, is not necessary flat throughout the drilling MD.

Figure 5:
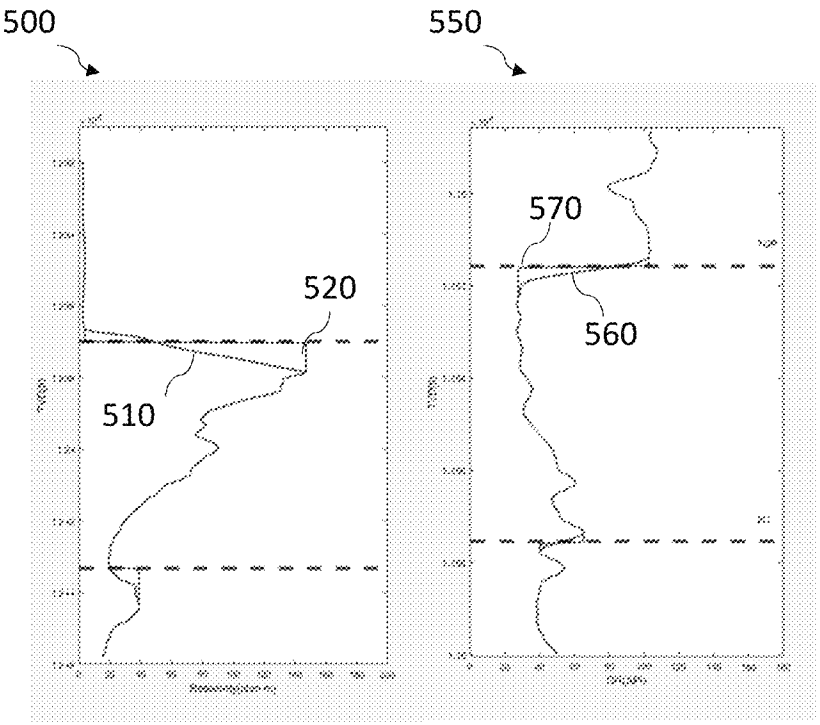
FIG. 5 illustrates a diagram of an example of processing offset well data by squaring the offset well data.

In step 317 the offset well data is processed. Step 317 specifically denotes squaring the offset well data to increase the accuracy and resolution of the final generated heat maps. Having a sharp change at chosen RVDs instead of a gradual change can be beneficial when generating combined heat maps. FIG. 5 displays example diagrams 500 and 550 of offset well resistivity and gamma ray data showing a squared log compared to the original data near RVDs, which are represented by dashed lines. Examples of the original data at one RVD is denoted as 510 and the squared data 520 in diagram 500 and the original data is denoted as 560 and the squared data 570 in diagram 550. For diagram 500, the x axis is resistivity in ohms/feet and the y axis is TVD in feet. For diagram 550, the x axis is gamma ray readings in API units and the y axis is TVD in feet. Additional processing can also be performed. Since the offset well data can be actual signals or raw data that was collected during drilling of the offset well, the data can be noisy. As such, the offset well data can be processed to remove or at least reduce noise or other signal anomalies. Examples of other processing include filtering, smoothing, or other types of data processing that can be used to clean the offset well data. Some of the processing can occur before analyzing the offset well data, such as before step 313. Obtaining, analyzing and processing the offset well data as in steps 305 and 310 can be performed before drilling begins for the target well.

In step 320, drilling of the target well commences. The target well can be drilled according to a well plan to reach a target zone in a subterranean formation, such as target zone 160 of FIG. 1. A drilling controller, such as drilling controller 220 of FIG. 2, can be used to steer a drill bit to the target zone. The drilling controller can make steering decisions and generate steering commands based on the well plan. As noted below in step 380, the well plan can be updated.

In step 325, target well drilling data is obtained. The target well drilling data can be obtained in real-time as the target well is being drilled. The real-time data includes different types of drilling data and can be obtained from sensors, such as LWD sensors, MWD sensors, or other types of sensors associated with obtaining measurements during drilling. The sensor measurements may include but are not limited to gamma-ray, resistivity, density, porosity, etc. The real-time data may also be associated with drilling dynamics, such as ROP, WOB, RPM, etc. Sensors can also be used to obtain the different types of data associated with the drilling dynamics. The different types of drilling data obtained for the target well can correspond to the types of drilling data from the offset well data. As with the offset well data, the target well drilling data can be stored as raw data that needs to be processed (e.g., preprocessed) before being used in method 300. The processing can include one or more of the different types of processing that is performed on the offset well data, such as filtering, smoothing, or other types of data processing that can be used to clean (e.g., remove noise) the target well drilling data.

In step 330, individual heat maps are generated based on the target well drilling data and the offset well data. Individual heat maps can be generated for each of the different types of drilling data represented by the offset well data and the target well drilling data. A heat map is a matrix with elements that has values representing a misfit, such as between corresponding data of the offset well data and the target well drilling data. Considering k number of different types of drilling data, wherein k=1, 2, . . . , K, an individual misfit matrix for each heatmap for each different type of drilling data can be generated. For example, data from different types of sensors can be used and if only considering gamma-ray data, then k=1, and if considering both gamma-ray and resistivity sensor readings, then K is equal to 2). Individual misfit matrix for each heat map can be generated according to, for example, Equation 1 presented below:

$$M_k(i, j) = \frac{|O_k(i) - T_k(j)|}{D_k(i, j)} \qquad \text{Equation 1}$$

where $O_k(i)$ is the offset well log reading for sensor k (for example if k=1, then gamma-ray sensor reading) at i th TVD, where $TVD(i)=TVD_1, TVD_2, \ldots, RVD_1, \ldots, RVD_2, \ldots, TVD_n$, is the TVD for the offset well log. The TVD range can be chosen to include any part of offset well TVD values and should not necessarily include all TVDs. $T_k(j)$ is the target well log reading for sensor k, where $MD(j)=MD_1, MD_2, \ldots, MD_m$ is the measured depth (MD) for the target well log. As with TVD for the offset well, MD range can be selected to include any part of target well MD values. $D_k(i,j)$ is the measure of geological similarity between point i on offset well and point j on target well. $D_k$ is the measure of geological similarity of considered pairs (i and j). Thus, $D_k(i,j)$ is a large value if two points i and j are geologically different. $D_k$ can also be obtained from a spatial geological model (variogram model), or in the absence of sufficient geological models, $D_k$ can be $D_k(i,j)=\text{distance}(i,j)^{-1}$, by which the inverse of spatial distance between the considered pairs (i from offset well and j from target well) is assumed as a measure of similarity (i.e., the closer the points are greater is $D_k$). Alternatively, $D_k$ can be set to be 1 for all pairs on offset well and target well if the geology is unknown or for simplicity.

The misfit matrix $M_k(i,j)$ of Equation 1 can be completed column by column in real-time while drilling the target well. Since rows of $M_k$ are determined from offset well log (i.e. $i \in [1, 2, \ldots n]$), misfit matrix $M_k$ can be completed column-wise while drilling the target well and receiving target well drilling data (e.g., LWD sensor readings) for new MDs. Eventually, after drilling completion, $M_k$ would be a matrix of size n×m. $M_k$ of Equation 1 disclosed above provides an example for a misfit matrix calculation. Other types of misfit matrix calculations can also be used. For example, a Euclidean distance can be used in the numerator.

Figure 6B:
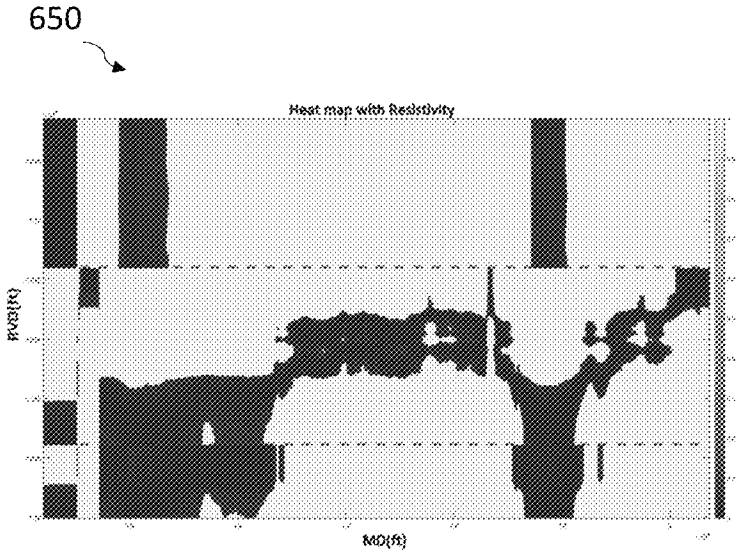
FIG. 6A and FIG. 6B illustrate examples of final color-coded individual heat map matrices using gamma-ray and resistivity sensor readings, respectively, according to the principles of the disclosure.
Figure 6A:
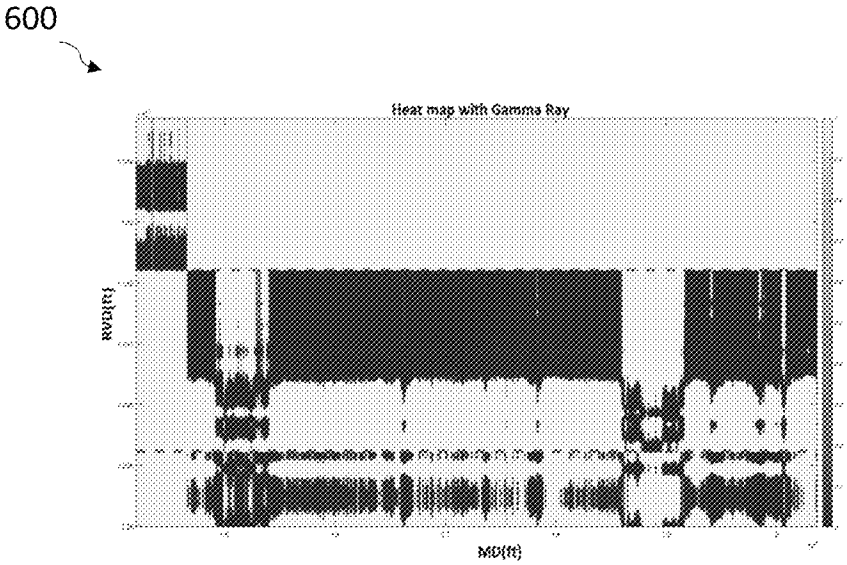

As new target well drilling data is received, such as from LWD/MWD sensors, and $M_k$ grows column-wise, each column can be normalized and color-coded resulting in a color-coded heat map matrix as $HM_k(i,j)$, for a type of drilling data. For example, if the target well drilling data includes measurements from three different types of sensors, such as gamma-ray, resistivity, and porosity for analysis, $HM_1$ can be the heat map matrix computed using only gamma-ray readings from offset well data and target well drilling data, and $HM_2$ and $HM_3$ can be the heat maps corresponding to resistivity and porosity sensor readings from the offset well data and the target well drilling data, respectively. FIG. 6A and FIG. 6B illustrate examples of final color-coded heat map matrices 600 and 650 using gamma-ray and resistivity sensor readings, respectively. For both FIG. 6A and FIG. 6B, the x axis is MD and the y axis is RVD in feet. Various normalization methods can be used, such as min-max feature scaling normalization for heat maps.

After generating the individual heat maps, a combined heat map is generated in step 340. The combined heat map can be generated using Equations 2 and Equation 3 presented below. In the case where multiple types of drilling data are represented in the offset well data and the target well drilling data (e.g., more than one kind of sensor readings) then k>1 and there are k numbers of individual heat maps $HM_k$ that are generated. The final combined heat map is computed as a weighted sum of each of the individual heat maps. Equation 2 below provides one example for generating a combined heat map. Equation 2:

$$HM_{comb}(i,j)=\alpha_1(j)HM_1(i,j)+\alpha_2(j)HM_2(i,j)+\ldots+\alpha_k(j)HM_k(i,j)$$

where $\alpha_1, \ldots, \alpha_k$ are depth varying weights selected for each of the individual heat maps.

For multiple types of drilling data (and consequently multiple heat maps), each heatmap's weight $\alpha_k$ needs to be determined. The weight for a heat map can vary while drilling, such as having different values in each MD while drilling. For example, in the case where the target well drilling data is from 3 sensors, (gamma-ray, resistivity, and density), at MD=1000 ft target well, a determination to assign $\alpha_1$ (1000 ft)=0.8 (for gamma-ray heatmap), $\alpha_2$ (1000 ft)=0.1 (for resistivity heatmap) and $\alpha_3$ (1000 ft)=0.1 (for density heatmap), can be made and the weights can be changed to other values at next logging MD.

Figure 7:
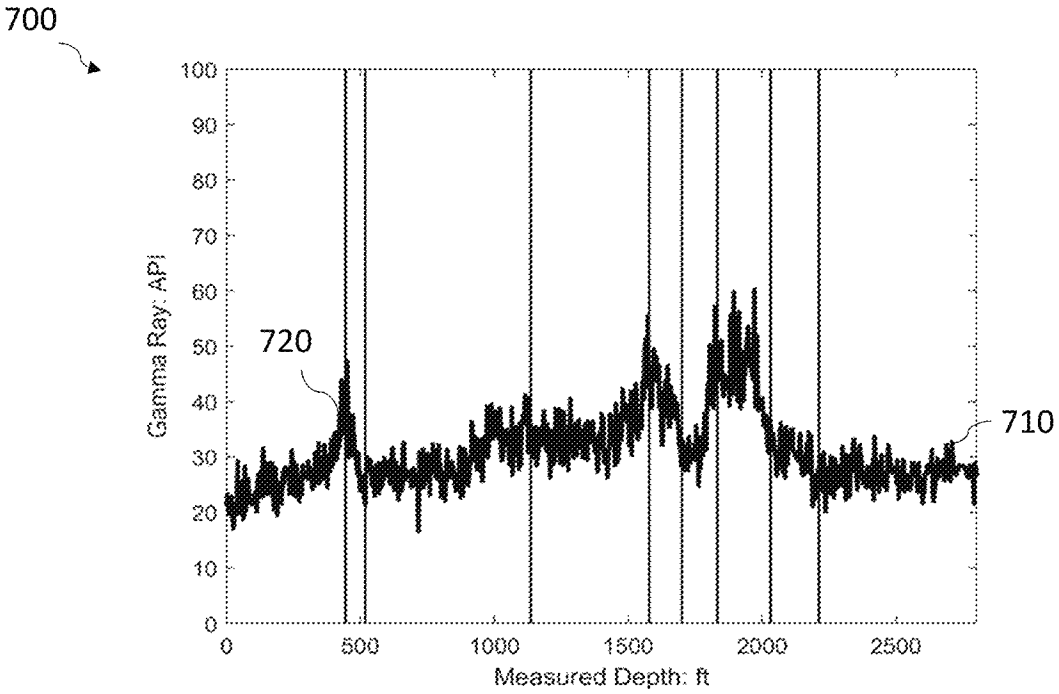
FIG. 7 illustrates an example of detecting control points for gamma-ray readings by detecting MDs for potential control points.

Different criteria can be used to determine an adaptation criteria at each MD for determining the weights. For instance, a control point detection algorithm can be used that considers target well readings for various sensor measurements, and receives an alarm from the control point detection algorithm for a potential control point possibility. For example, if control point detection algorithm detects potential control points using gamma-ray sensor readings at a certain MD, the heatmap weight ($\alpha_1$), at that MD can be increased and the other weights can be correspondingly lowered. FIG. 7 illustrates an example of detecting control points for gamma-ray readings by detecting MDs for potential control points.

FIG. 7 illustrates an example of a gamma ray profile that depicts gamma ray readings at various depths. The x-axis is measured depth in feet and the y-axis is gamma ray values measured in API units. Curve 710 represents gamma ray readings at each measured depth obtained by a gamma ray tool of BHA, such as BHA 120 of FIG. 1. Abrupt changes in gamma ray readings with respect to neighboring gamma ray readings may indicate, for example, that the wellbore has penetrated a formation boundary. A control point detection algorithm can be used to identify abrupt changes in the gamma ray measurements when a threshold is met, such as geological event 720. The measured depth and gamma ray reading at geological event 720 can be labeled as a potential control point and communicated for interpretation and possible weighting. In FIG. 7, vertical lines are used to identify potential control points. Once the control point detection algorithm finds an interesting change/feature (a potential correlation point) in one of the sensor readings, then it is reasonable to increase the contribution of the individual heat map for the same sensor at the same MD by increasing the heatmap weight relative to other weights of the heatmap. A similar procedure can be used for other considered sensor readings being used for geosteering interpretation.

Figure 8:
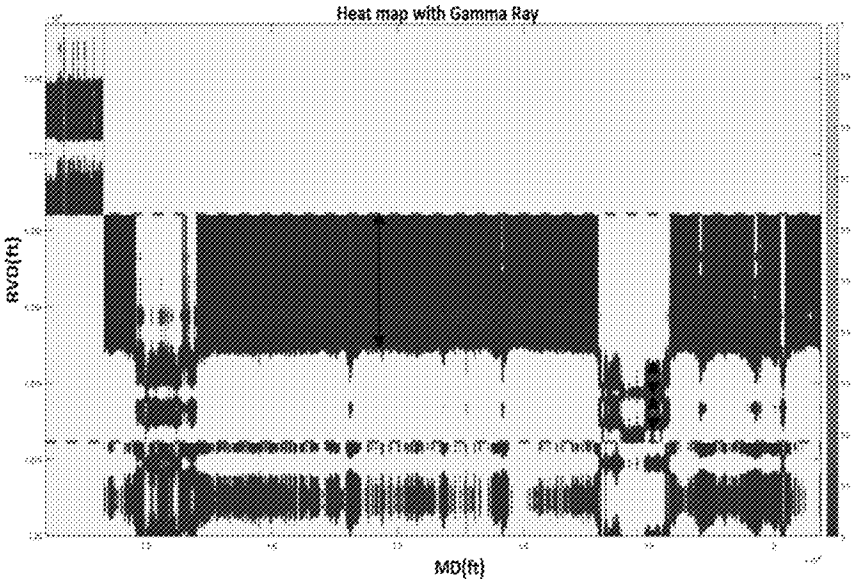
FIG. 8 illustrates an individual heat map that provides an example of higher and lower misfit areas between an offset well and a target well.

Furthermore, the adaptation criteria for determining weights can also be computed by considering the width/number of observable RVDs at each MD. For example, the individual heatmap 800 shown in FIG. 8 wherein the x axis is MD and the y axis is RVD (both in feet). FIG. 8 is computed by gamma-ray sensor measurements only, the lower misfit areas (darker color on heatmap) correspond to better correlation between an offset well and a target well and greater possibility for the borehole at each MD to be at the corresponding RVD. Considering each column (MD) in the heatmap, the narrower the darker region (low misfit value), the more confidence for selecting the borehole location in the considered geology (relative to RVDs and selected bed boundaries and markers) using the corresponding LWD sensor readings (shown via arrows on FIG. 8).

Considering d(MD) as the cumulative number of low misfit (darker color on heatmap) rows (RVDs), a threshold on the misfit value, $h_0$, may be considered to select low misfit rows in the heatmap for each logging MD, i.e. count ($HM_1(i, MD)<h_0$) and $d_t$ as RVD range length (heatmap window width), heatmap weights $\alpha_k$ (MD) can be selected as follows using Equation 3:

$$\alpha_1(MD) = 1 - \frac{d(MD)}{d_t}, \qquad \text{(Equation 3)}$$

$$\alpha_k(MD) = \frac{1-\alpha_1}{K-1}, \text{ where } \sum_{k=1}^{K}\alpha_k = 1$$

Considering Equation 3, if a darker color area (low misfit) in the first sensor heatmap is wider, it will lead to lower weight $\alpha_1$ and higher weights for other the individual heatmaps of the other sensors. Such adaptation law will allow sensors that may provide better observability in the heatmap to contribute more to the final adaptive combined heatmap. Other approaches/functions/formulas may be used instead of Equation 3 to determine heatmap weights and Equation 2 for a combined heatmap matrix.

The method 300 continues to step 350 where a determination is made if a path is observable in the combined heat map. After determining the weights, using for example Equation 3, and computing the combined heatmap matrix, using for example Equation 2, a determination can be made if the current logging MD in the adaptive combined heatmap is observable or not in the adaptive combined heatmap. A threshold can be used to determine observability. For example, if all the rows (RVDs) in the adaptive combined heatmap for the corresponding MD have a greater misfit than a selected misfit threshold, $h_0$, then the automated interpretation at that MD represented by the adaptive combined heatmap cannot be relied upon for steering. Therefore, the method 300 continues to step 320 and the drilling operation for the target well based on a pre-drill well plan at that MD is used for steering.

However, if there is at least one row (RVD) of the adaptive combined heatmap with a lower misfit than $h_0$, then the method 300 continues to step 360 and a path for the target well is determined. The path can be automatically determined by, for example, choosing a minimum cost path. FIG. 9 illustrates a heatmap matrix 900 and an example of a process of determining a path according to the principles of the disclosure. The process represented in FIG. 9 corresponds to a pathfinder algorithm that is used to interpret a relative location of a target well in the subterranean formation. The pathfinder algorithm is an optimization-based algorithm looking for minimum cumulative misfit in the final combined heatmap matrix along with logging MD range. Pathfinder algorithm finds the lowest misfit (darker color on heatmap) values, which represents the most probable relative location of the target well in the RVD-MD domain. As shown in FIG. 9, the pathfinder algorithm has two tuning parameters, namely, $N_{search}$, and $N_{lookahead}$, that can be adjusted based on geosteering objectives. For the illustrated example of FIG. 9, pathfinder algorithm can lag $N_{lookahead}$ steps from the most recent logging MD. In FIG. 9, the x axis is MD in feet and the y axis is RVD in feet.

In FIG. 9, if the current borehole interpretation or path of the target well is at column j (shown by a star), the pathfinder algorithm is choosing the minimum cost path among $N_{paths}=(2N_{search}+1)N_{lookahead}$ number of paths as follows:

$$\text{Path}^* = \min(\text{Path}_1, \text{Path}_2, \ldots, \text{Path}_{N_{paths}}) \quad \text{(Equation 4)}$$

where Path is the cumulative cost (misfit) of the selected path. After finding the minimum cost path, Path*, the algorithm moves forward only one step in the direction of Path* (i.e. only implement the first movement direction) and then the geological model and interpretation are updated and search horizon $N_{lookahead}$ moves ahead correspondingly and method 300 continues.

In the illustrated example of FIG. 9, $N_{search}=2$, $N_{lookahead}=3$, which means that the pathfinder at column j can look for 2 ($N_{search}$) rows above or below its current row (RVD) or it can remain in the same row. Moreover, the same search process is repeated for the next $N_{lookahead}$ columns (MDs) resulting in $N_{paths}$ number of different paths that each have a cumulative cost (misfit). For large tuning parameters, efficient algorithms such as dynamic programming may be used to find the optimum solution (interpretation) at each step (MD).

Moreover, pathfinder algorithm tuning parameters can be adjusted for various purposes. For example selecting small $N_{search}$ and large $N_{lookahead}$ parameters will result in a smoother interpretation. Due to large $N_{lookahead}$, however, the interpretation will be delayed. On the other hand, choosing large $N_{search}$ and small $N_{lookahead}$ parameters will result in better fault detection since the algorithm has the capability to jump further to capture features related to faults, etc. and can capture instantaneous formation features/changes such as formation faults, anisotropy, nuggets, etc.

After receiving the interpretation from the adaptive combined heatmap and locating a path, the geological model can be updated in step 370. Updating the geological model can be in terms of the relative location of the target well in the geology, such as relative distance to RVD markers. The well plan or steering decisions may be modified in step 380 according to the updated geological model to satisfy the drilling/geosteering objectives. For example, such objectives can be steering the wellbore in a certain formation/layer or keeping the wellbore with a specified distance from a certain bed boundary, etc.

With the updated well plan, method 300 continues to step 320 where the drilling operation continues. Method 300 will continue and the automated geosteering interpretation will be repeated for the next logging MD and target well drilling data.

FIG. 10 illustrates an example of an adaptive combined heatmap 1000 that includes a human interpretation of a drilling geosteering job and an automated interpretation of the drilling geosteering job determined according to the principles of the disclosure. For the example of FIG. the real-time automated geosteering interpretation used gamma-ray, resistivity, and density sensor measurements to develop an adaptive combined heatmap in real-time while drilling and logging. In FIG. 10, curve 1010 represents the automated interpretation of the target well location in the RVD-MD domain versus human interpretation shown by curve 1020. The automated interpretation provides a close proximity to the human interpretation capturing major events and features in spite of utilizing a lower number of sensor readings and drilling information compared to the human interpretation. Instead of only three different types of drilling data, the human geologist/geosteerer used multiple sensor readings, image logs, etc. for making the human interpretation, which can be subjective and highly dependent on the geosteering geologist's experience, knowledge, and other factors. Also, in the real geosteering job, the ground truth is not clear, so human interpretation may also be inaccurate or exaggerated.

In FIG. 10, RVD 1 and RVD 2 are denoting two bed boundaries that have been selected from offset well(s) information as reference markers. Since RVDs are selected from offset well log(s), they appear flat (horizontal lines) in the RVD-MD domain (in heatmaps), although bed boundaries are not flat in the real geology (for example in the TVD-MD domain).

A portion of the above-described apparatus, systems or methods may be embodied in or performed by various analog or digital data processors, wherein the processors are programmed or store executable programs of sequences of software instructions to perform one or more of the steps of the methods. A processor may be, for example, a programmable logic device such as a programmable array logic (PAL), a generic array logic (GAL), a field programmable gate arrays (FPGA), or another type of computer processing device (CPD). The software instructions of such programs may represent algorithms and be encoded in machine-executable form on non-transitory digital data storage media, e.g., magnetic or optical disks, random-access memory (RAM), magnetic hard disks, flash memories, and/or read-only memory (ROM), to enable various types of digital data processors or computers to perform one, multiple or all of the steps of one or more of the above-described methods, or functions, systems or apparatuses described herein.

Portions of disclosed examples or embodiments may relate to computer storage products with a non-transitory computer-readable medium that have program code thereon for performing various computer-implemented operations that embody a part of an apparatus, device or carry out the steps of a method set forth herein. Non-transitory used herein refers to all computer-readable media except for transitory, propagating signals. Examples of non-transitory computer-readable media include, but are not limited to: magnetic media such as hard disks, floppy disks, and magnetic tape; optical media such as CD-ROM disks; magneto-optical media such as floppy disks; and hardware devices that are specially configured to store and execute program code, such as ROM and RAM devices. Examples of program code include both machine code, such as produced by a compiler, and files containing higher level code that may be executed by the computer using an interpreter.

In interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Those skilled in the art to which this application relates will appreciate that other and further additions, deletions, substitutions and modifications may be made to the described embodiments. It is also to be understood that the terminology used herein is for the purpose of describing particular embodiments only, and is not intended to be limiting, because the scope of the present disclosure will be limited only by the claims. Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, a limited number of the exemplary methods and materials are described herein.

Each of the aspects disclosed in the summary can have one or more of the following additional elements in combination. Element 1: wherein generating the adaptive combined heatmap includes adaptively weighting the individual heatmaps for measured depths of the target well. Element 2: wherein the adaptively weighting is based on a width of lower misfit areas of the adaptive combined heatmap at the measured depths of the individual heatmaps. Element 3: wherein the path is a low cumulative misfit path on the adaptive combined heatmap. Element 4: further comprising drilling the target well using the updated well plan. Element 5: wherein the target well drilling data is from real-time measurements obtained during drilling of the target well. Element 6: wherein the real-time measurements are sensor measurements from sensors selected from the group consisting of gamma-ray sensors, resistivity sensors, density sensors, porosity sensors, drilling dynamic sensors, acoustic sensors, and nuclear magnetic resonance sensors. Element 7: wherein the generating the individual heatmaps is based on well logs from multiple offset wells that are combined together. Element 8: further comprising determining geological characteristics from the offset well data and denoting a reference vertical depth (RVD) for one or more of the geological characteristics in the individual heatmaps. Element 9: wherein the operations further include determining a path of the target well in the subterranean formation based on the adaptive combined heatmap and the steering of the drill bit uses the path. Element 10: wherein the path is a low cumulative misfit path on the adaptive combined heatmap. Element 11: wherein the adaptively weighted individual heatmaps are weighted based on a width of lower misfit areas of the adaptive combined heatmap at the measured depths of the individual heatmaps. Element 12: wherein generating the individual heatmaps, generating the adaptive combined heatmap, and steering the drill bit are performed in real-time. Element 13: wherein the target well drilling data is from one or more well logs of the target well that are generated in real-time from sensor measurements. Element 14: further comprising the drill bit and multiple sensors configured to obtain the target well drilling data during drilling of the target well. Element 15: wherein the operations further include determining geological characteristics from the offset well data and denoting a reference vertical depth (RVD) for one or more of the geological characteristics in the individual heatmaps. Element 16: wherein the operations include updating a geological model of the subterranean formation for the target well using the combined heat map and updating a well plan based on the updated geological model, wherein the steering of the drill bit is based on the updated well plan. Element 17: wherein the operations further include steering a drill bit for the target well using the path.

What is claimed is:

1. An automated method of drilling a target well according to a well plan, comprising:

generating at least two individual heatmaps for a subterranean formation using target well drilling data from a target well and offset well data from at least one offset well, wherein each of the individual heatmaps correspond to a specific type of drilling data;

generating an adaptive combined heatmap from the individual heatmaps by adaptively weighting the individual heatmaps with weights corresponding to measured depths of the target well based on a width of lower misfit areas of the individual heatmaps at the measured depths, wherein the adaptive combined heatmap is a weighted sum of the individual weighted heatmaps;

determining a path of the target well in the subterranean formation based on the adaptive combined heatmap;

updating the well plan according to the path, and drilling the target well using the updated well plan.

2. The automated method as recited in claim 1, wherein individual heatmaps having a greater width of a lower misfit area are weighted lower than individual heatmaps having a lower width of a lower misfit area.

3. The automated method as recited in claim 2, wherein generating the adaptive combined heatmap includes combining the weighted individual heatmaps.

4. The automated method as recited in claim 1, wherein the path is a low cumulative misfit path on the adaptive combined heatmap.

5. The automated method as recited in claim 1, wherein the generating the individual heatmaps is based on well logs from multiple offset wells that are combined together.

6. The automated method as recited in claim 1, further comprising determining geological characteristics from the offset well data and denoting a reference vertical depth (RVD) for one or more of the geological characteristics in the individual heatmaps.

7. The automated method as recited in claim 1, wherein the target well drilling data is from real-time measurements obtained during drilling of the target well.

8. The automated method as recited in claim 7, wherein the real-time measurements are sensor measurements from sensors selected from the group consisting of:

gamma-ray sensors,
resistivity sensors,
density sensors,
porosity sensors,
drilling dynamic sensors,
acoustic sensors, and
nuclear magnetic resonance sensors.

9. An automated directional drilling system, comprising:

one or more processors to perform operations including:

generating at least two individual heatmaps for a subterranean formation using target well drilling data from a target well and offset well data from at least one offset well, wherein each of the individual heatmaps correspond to a specific type of drilling data;

generating an adaptive combined heatmap from the individual heatmaps, wherein the individual heatmaps are adaptively weighted with weights corresponding to measured depths of the target well based on a width of lower misfit areas of the individual heatmaps at the measured depths, wherein the adaptive combined heatmap is a weighted sum of the individual weighted heatmaps; and steering a drill bit in the subterranean formation based on the adaptive combined heatmap.

10. The automated directional drilling system as recited in claim 9, wherein the operations further include determining a path of the target well in the subterranean formation based on the adaptive combined heatmap and the steering of the drill bit uses the path.

11. The automated directional drilling system as recited in claim 10, wherein the path is a low cumulative misfit path on the adaptive combined heatmap.

12. The automated directional drilling system as recited in claim 9, wherein individual heatmaps having a greater width of a lower misfit area are weighted lower than individual heatmaps having a lower width of a lower misfit area.

13. The automated directional drilling system as recited in claim 9, wherein generating the individual heatmaps, generating the adaptive combined heatmap, and steering the drill bit are performed in real-time.

14. The automated directional drilling system as recited in claim 9, wherein the target well drilling data is from one or more well logs of the target well that are generated in real-time from sensor measurements.

15. The automated directional drilling system as recited in claim 9, further comprising the drill bit and multiple sensors configured to obtain the target well drilling data during drilling of the target well.

16. The automated directional drilling system as recited in claim 9, wherein the operations further include determining geological characteristics from the offset well data and denoting a reference vertical depth (RVD) for one or more of the geological characteristics in the individual heatmaps.

17. The automated directional drilling system as recited in claim 9, wherein the operations include updating a geological model of the subterranean formation for the target well using the combined heat map and updating a well plan based on the updated geological model, wherein the steering of the drill bit is based on the updated well plan.

18. A computer program product including a non-transitory computer readable medium having a series of operating instructions that direct a processor when initiated thereby to automatically interpret geological data of a subterranean formation and a position of a target well in the subterranean formation in real-time by performing operations including:

generating at least two individual heatmaps for a subterranean formation using target well drilling data from a target well and offset well data from at least one offset well, wherein each of the individual heatmaps correspond to a specific type of drilling data;

adaptively weighting the individual heatmaps with weights corresponding to measured depths of the target well based on a width of lower misfit areas of the individual heatmaps at the measured depths;

generating an adaptive combined heatmap from the adaptively weighted individual heatmaps, wherein the adaptive combined heatmap is a weighted sum of the individual weighted heatmaps;

and determining a path of the target well in the subterranean formation using the adaptive combined heatmap, wherein the path is a low cumulative misfit path on the adaptive combined heatmap, wherein the operations further includes steering a drill bit for the target well using the path.

* * * * *